US006474128B1

(12) United States Patent
Liu

(10) Patent No.: US 6,474,128 B1
(45) Date of Patent: Nov. 5, 2002

(54) METHOD FOR FOLDING OVER PLATE

(75) Inventor: Yao-Tser Liu, Tao-Yuan (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/717,572

(22) Filed: Nov. 21, 2000

(30) Foreign Application Priority Data

Sep. 1, 2000 (TW) ..... 089117948 A

(51) Int. Cl.[7] ..... B21D 19/08
(52) U.S. Cl. ..... 72/379.2
(58) Field of Search ..... 72/379.2, 380; 29/243.58

(56) References Cited

FOREIGN PATENT DOCUMENTS

JP 3-204124 * 9/1991 ..... 72/379.2

* cited by examiner

*Primary Examiner*—Lowell A. Larson
(74) *Attorney, Agent, or Firm*—Wei Te Chung

(57) ABSTRACT

A method of the present invention for folding over a plate (90) includes the steps of: providing a first mold assembly to dent a notch (94) at a place of the plate to be bent and simultaneously form a curved portion (98) at an end of the plate which has a rounded comer (96) with a 1.0 millimeter radius; providing a second mold assembly to bend the plate 90 degrees at the notch; and providing a third mold assembly to finally fold over the plate with a rammer (60") acting on the curved portion and thereupon flattening the curved portion.

11 Claims, 7 Drawing Sheets

METHOD FOR FOLDING OVER PLATE

BACKGROUND OF THE INVENTION

1. Field of the Invention

The present invention relates to a method for folding over a plate, and particularly to a method which minimizes generation of harmful detritus.

2. Related Art

In the process of stamp-forming a plate, various methods for folding over a plate are used. A conventional method for folding over a plate is shown in FIGS. 4A–4C. A notch is dented into the plate at the place to be bent, as shown in step 11. The depth of the notch is approximately equal to half the thickness of the plate. Then the plate is bent 90 degrees at the notch, as shown in step 12. Finally, the plate is compressed until both portions thereof closely touch each other, as shown in step 13.

Another conventional method for folding over a plate is shown in FIGS. 5A–5D. A notch is dented in the plate at the place to be bent, as shown in step 11'. The plate is bent 90 degrees at the notch, as shown in step 12'. The plate is then bent a further 45 degrees, as shown in step 21. Finally, the plate is compressed until both portions thereof closely touch each other, as shown in step 13'.

Still another conventional method for folding over a plate is shown in FIGS. 6A–6C. A notch is dented in the plate at the place to be bent, as shown in step 11". A comer of the portion to be folded over is chamfered. The plate has a thickness T. Half of the edge of the plate at which the comer is located remains straight, thus defining a distance T/2. The arc formed by the chamfer has a 1.0 millimeter radius. The plate is bent 90 degrees, as shown in step 12". The plate is compressed until both portions thereof closely touch each other, as shown in step 13". During such compression, the chamfer helps reduce friction between the plate and a rammer which punches the plate.

FIGS. 7A and 7B show a process of finally folding over a plate 50, in accordance with the conventional method illustrated in FIG. 4. The plate 50 is bent 90 degrees at a notch (not labeled) to form an upright foldedover portion 52. An L-shaped rammer 40 moves in direction C. The rammer 40 progressively rubs a side wall 522 of the foldedover portion 52, and thereby scrapes some hairlike chips and detritus 54 off of the side wall 522. Such chips and detritus 54 can change the size of the plate 50 and can reduce the quality of the plate 50.

Thus a method for folding over a plate which solves the above problems is desired.

SUMMARY OF THE INVENTION

Accordingly, an object of the present invention is to provide a method for folding over a plate which results in accurate sizing of the plate.

Another object of the present invention is to provide a method for folding over a plate which minimizes generation of detritus harmful to the plate.

To achieve the above-mentioned objects, a method of the present invention for folding over a plate comprises the steps of: providing a first mold assembly to dent a notch at the place of the plate to be bent and simultaneously form a curved portion at an end of the plate which has a rounded comer with a 1.0 millimeter radius; providing a second mold assembly to bend the plate 90 degrees at the notch; and providing a third mold assembly to finally fold over the plate with a rammer acting on the curved portion of the plate and thereupon flattening the curved portion.

Other objects, advantages and novel features of the present invention will be drawn from the following detailed embodiment of the present invention with attached drawings, in which:

DESCRIPTION OF THE PREFERRED EMBODIMENT

Figure 1:
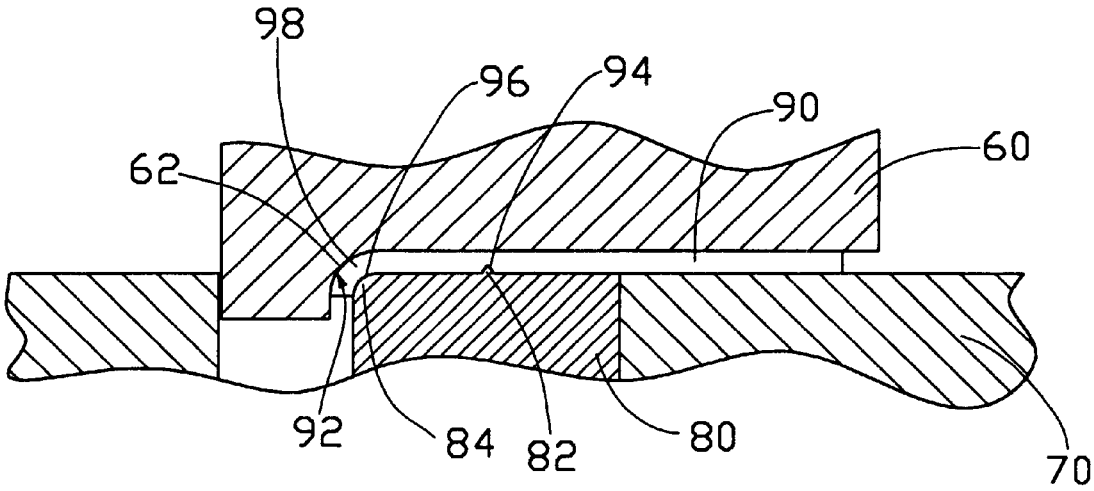
FIG. 1 is a schematic cross-section view showing a process in accordance with the present invention for denting a notch in a plate and forming a curved portion.

Referring to FIG. 1, a method of the present invention for folding over a plate includes denting a notch 94 in a plate 90. The denting process uses a first rammer 60, a first lower mold block 70, and an insert block 80. The first rammer 60 forms a filleted comer 62, the radius of the comer 62 being 1.0 millimeter plus the thickness of the plate 90. A top surface of the insert block 80 is coplanar with a top surface of the first lower mold block 70. The top surface of the insert block 80 forms a triangular rib 82, the height of the rib 82 being half the thickness of the plate 90. One upper end of the insert block 80 forms a bullnose 84, the radius of the bullnose 84 being 1.0 millimeter.

In manufacture, the plate 90 is placed onto the first lower mold block 70. The rib 82 of the insert block 80 is in contact with a bottom surface of the plate 90. The rammer 60 is moved downwardly, thereby forcing the rib 82 to dent a notch in the plate 90. Simultaneously, the filleted comer 62 of the rammer 60 and the bullnose 84 of the insert block 80 cooperatively form a curved portion 98 at an end of the plate 90. The curved portion 98 comprises a nose 92 and a rounded comer 96. The radius of the rounded comer 96 is 1.0 millimeter, and the radius of the nose 92 is 1.0 millimeter plus the thickness of the plate 90.

Figure 2A:
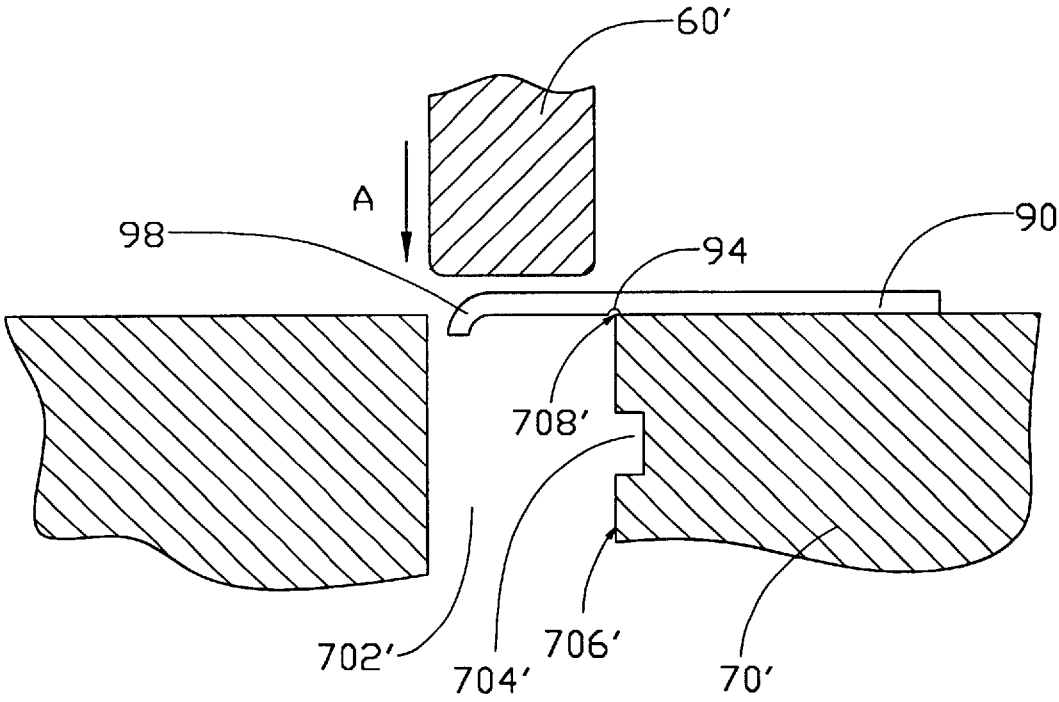
FIGS. 2A and 2B are schematic cross-section views showing a process in accordance with the present invention for bending the plate 90 degrees.
Figure 2B:
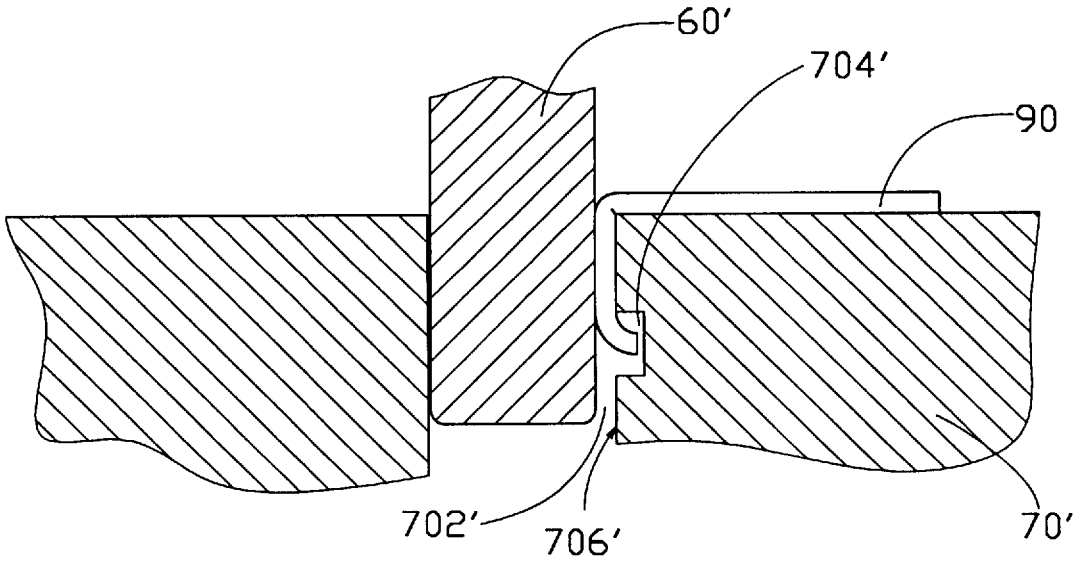

Referring to FIGS. 2A and 2B, the subsequent bending process uses a second rammer 60' and a second lower mold block 70'. The second lower mold block 70' has a vertical passageway 702' defined therethrough. An internal side wall 706' of the second lower mold block 70' forms one extremity of the passageway 702'. A rabbet 704' is defined in the side wall 706', in communication with the passageway 702'. An edge 708' is formed where the side wall 706' meets a top surface of the second lower mold block 70'. The plate 90 is placed on the second lower mold block 70', with the notch 94 of the plate 90 opposing the edge 708' of the second lower mold block 70'. The second rammer 60' is moved downwardly in direction A, and enters the passageway 702' of the second lower mold block 70'. The plate 90 is thereby bent downwardly 90 degrees, and the curved portion 98 of the plate 90 is thereby received in the rabbet 704' of the second lower mold block 70'.

Figure 3A:
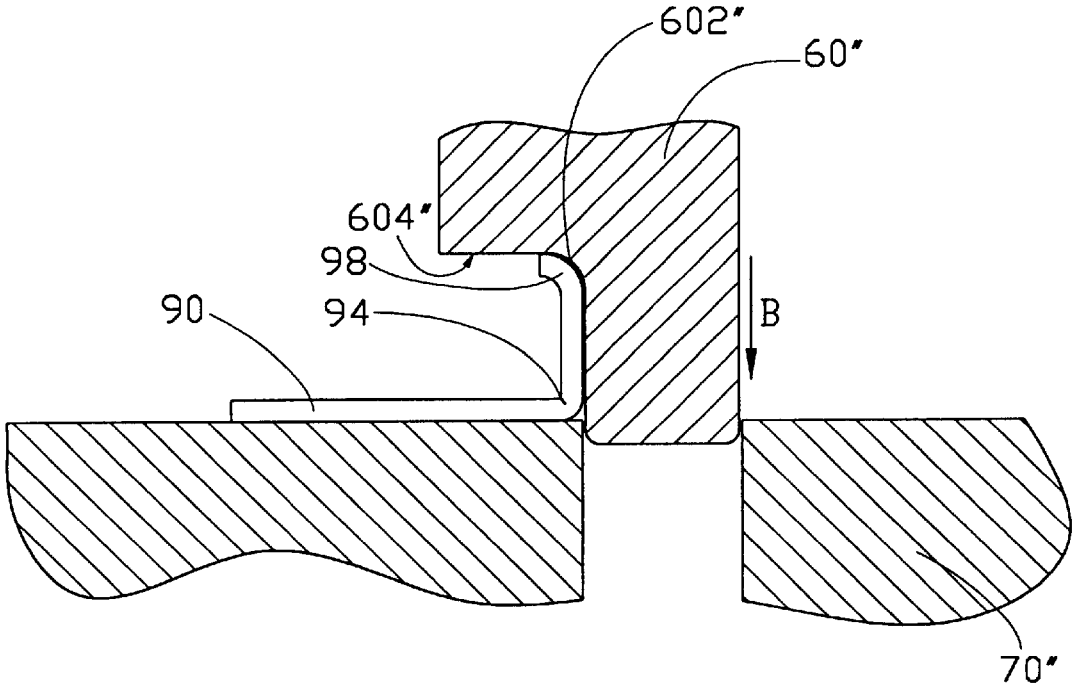
FIGS. 3A and 3B are schematic cross-section views showing a process in accordance with the present invention for finally folding over the plate.
Figure 3B:
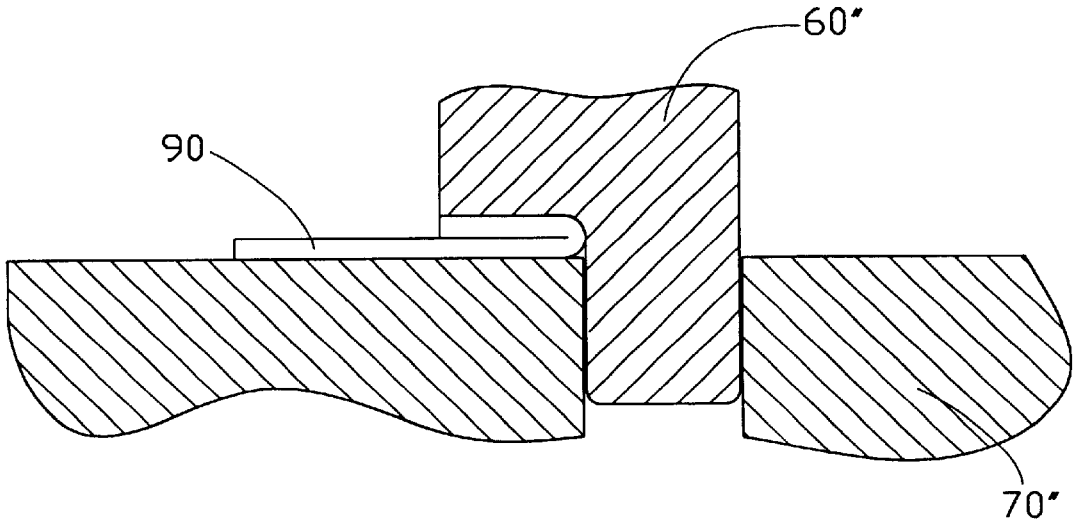
Figure 4A:
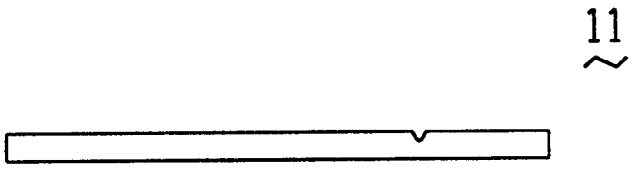
FIGS. 4A–4C are schematic cross-section views showing steps involved in a conventional method for folding over a plate.
Figure 4B:
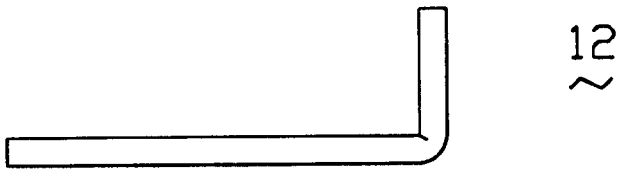
Figure 4C:
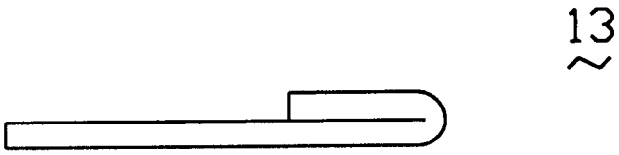
FIG. 4C (PRIOR ART)
Figure 5A:
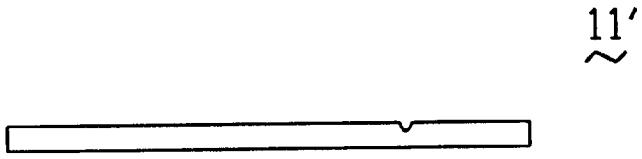
FIGS. 5A–5D are schematic cross-section views showing steps involved in another conventional method for folding over a plate.
Figure 5B:
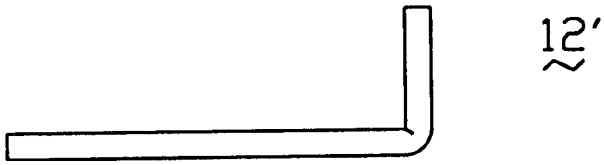
Figure 5C:
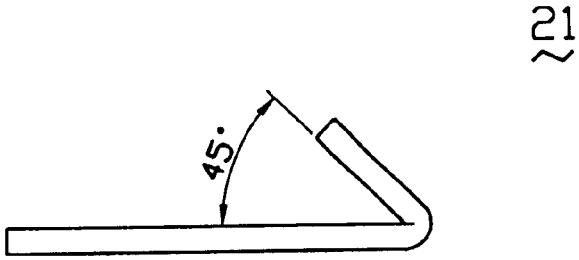
Figure 5D:
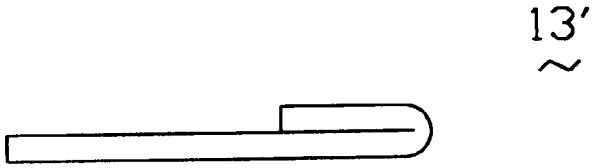
FIG. 5D (PRIOR ART)
Figure 6A:
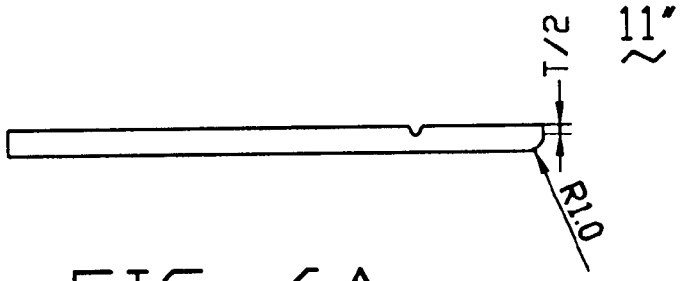
FIGS. 6A–6C are schematic cross-section views showing steps involved in still another conventional method for folding over a plate.
Figure 6B:
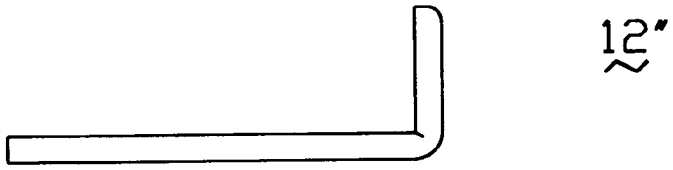
Figure 6C:
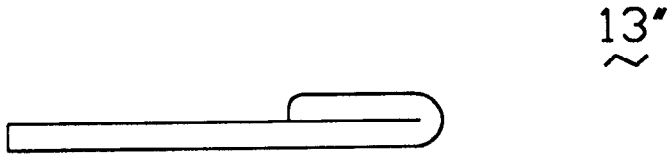
FIG. 6C (PRIOR ART)
Figure 7A:
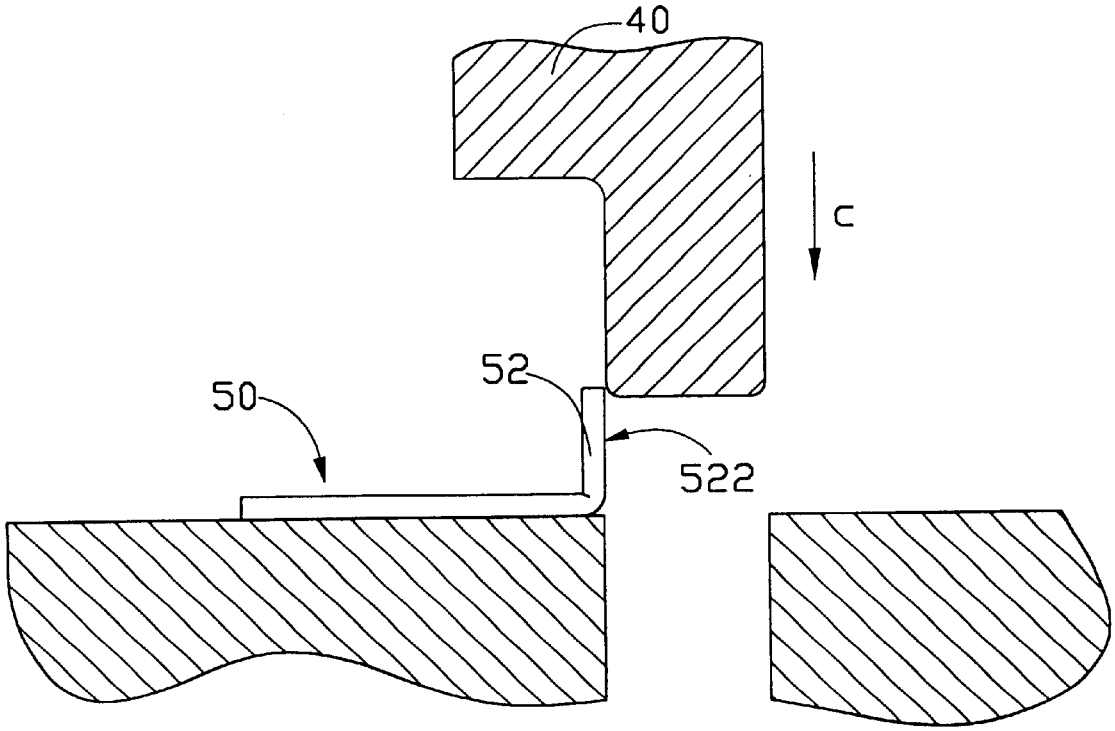
FIGS. 7A and 7B are schematic cross-section views of part of the method of FIG. 4, showing a rammer acting on the plate.
Figure 7B:
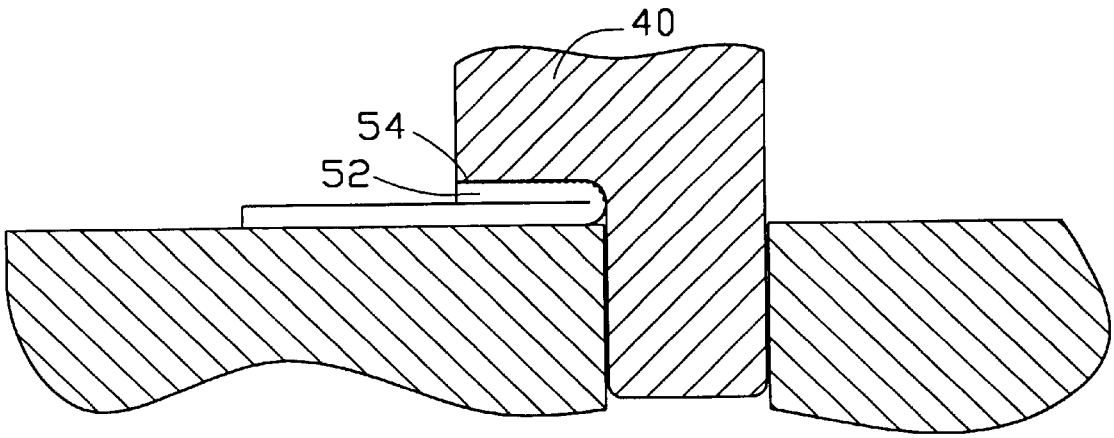
FIG. 7B (PRIOR ART)

Referring to FIGS. 3A and 3B, the final folding over process uses a third rammer 60"and a third lower mold block 70". The third rammer 60"is L-shaped, and has both a filleted comer 602"and a horizontal contact surface 604" inside the elbow of the L-shape. The plate 90 is placed on the third lower mold block 70" such that the curved portion 98 of the plate 90 opposes the filleted comer 602" of the third rammer 60". The third rammer 60" is moved downwardly in direction B to compress the plate 90. Thereupon, the curved portion 98 of the plate 90 is flattened by the third rammer 60".

The method of the present invention for folding over the plate includes forming the curved portion 98, which comprises the nose 92 and the rounded comer 96. In the final folding over process illustrated in FIGS. 3A and 3B, the nose 92 of the plate 90 progressively moves across the horizontal contact surface 604" of the third rammer 60". Different points of the nose 92 progressively rub across different points of the contact surface 604". Because the nose 92 is large and curved, the amount of friction resulting between the nose 92 and the contact surface 604" during such movement is minimized. Thus few if any chips and detritus are scraped off of the nose 92 during such movement. Thus the plate 90 is formed to its intended dimensions, and minimal or no damage is caused to the plate 90 by any such chips and detritus.

It is understood that the invention may be embodied in other forms without departing from the spirit thereof. Thus, the present example and embodiment are to be considered in all respects illustrative and not restrictive, and the invention is not to be limited to the details given herein.

What is claimed is:

1. A method for folding over a plate, comprising the steps of:

providing a first mold assembly to dent a notch in the plate and to form a curved portion at an end of the plate;

providing a second mold assembly to bend the plate at the notch; and providing a third mold assembly to act on the curved portion of the plate and thereby fold over the plate and flatten the curved portion.

2. The method for folding over a plate as described in claim 1, wherein the curved portion has a rounded corner.

3. The method for folding over a plate as described in claim 2, wherein the rounded comer has a 1.0 millimeter radius.

4. The method for folding over a plate as described in claim 1, wherein the plate is bent 90 degrees at the notch.

5. The method for folding over a plate as described in claim 1, wherein the depth of the notch is half the thickness of the plate.

6. The method for folding over a plate as described in claim 1, wherein the first mold assembly comprises a first rammer, a first lower mold block, and an insert block.

7. The method for folding over a plate as described in claim 6, wherein a top surface of the insert block is coplanar with a top surface of the first lower mold block, and wherein the insert block forms a triangular rib to dent the notch in the plate.

8. The method for folding over a plate as described in claim 1, wherein the second mold assembly comprises a second rammer and a second lower mold block, a rabbet being defined in a side wall of the second lower mold block for receiving the curved portion.

9. The method for folding over a plate as described in claim 1, wherein the third mold assembly comprises a third rammer and a third lower mold block, the third rammer being L-shaped in profile and defining a filleted comer for opposing the curved portion of the plate.

10. A combination including:

a first mold including two side-by-side pieces defining a space therebetween;

a second mold including a right angle piece wherein a vertical section thereof is adapted to be moveable within said space;

a right angle plate positioned between said first and second molds, said plate including a horizontal portion abutting against the first mold, and a vertical portion abutting against the vertical section of the second mold; wherein said vertical portion includes a curved portion at a distal end which is compliantly received within an intersection comer of said second mold whereby the vertical portion is smoothly moved along the second mold and reversely bent to be folded horizontally on the horizontal portion and the curved portion is flattened when the second mold moves toward the first mold.

11. A right-angle type semi-finished plate made via an intermediate molding process, comprising:

a horizontal portion and a vertical portion bent with a right angle configuration therebetween via a notch located around an intersection comer;

said horizontal portion and said vertical portion were originally coplanar with each other via an initial molding process, while will be reversely folded with each other after a final molding process; wherein said vertical portion includes a curved portion at a distal free end which was formed in the initial molding process while will be flattened after the final molding process.

* * * * *